US006030743A

United States Patent [19]

Okumura et al.

[11] Patent Number: 6,030,743

[45] Date of Patent: Feb. 29, 2000

[54] METHOD FOR MANUFACTURING PATTERN SHEET FOR PLATE-MAKING

[75] Inventors: Takashi Okumura, Nagoya; Mitsunobu Suda, Ichinomiya; Koji Sugiyama; Keiji Seo, both of Nagoya, all of Japan

[73] Assignee: Brother Kogyo Kabushiki Kaisha, Nagoya, Japan

[21] Appl. No.: 09/048,219

[22] Filed: Mar. 26, 1998

[30] Foreign Application Priority Data

Mar. 28, 1997 [JP] Japan ..... 8-078599

[51] Int. Cl.[7] ..... G03C 5/16

[52] U.S. Cl. ..... 430/203; 430/257; 430/258; 430/260; 430/261; 430/300; 430/301; 430/351; 430/944

[58] Field of Search ..... 430/367, 364, 430/334, 351, 257, 261, 260, 944, 203, 300, 301, 258

[56] References Cited

U.S. PATENT DOCUMENTS 3,767,394 10/1973 Wiese, Jr. et al. .

3,836,368 9/1974 Jun et al. .

FOREIGN PATENT DOCUMENTS 8-118771 5/1996 Japan .
8-207409 8/1996 Japan .
958962 5/1964 United Kingdom .

*Primary Examiner*—Thorl Chea
*Attorney, Agent, or Firm*—Oliff & Berridge, PLC

[57] ABSTRACT

A method for manufacturing a pattern sheet for plate-making capable of easily forming a positive image through the use of a photographic negative film. In this method, as a first step, a negative film with a printed negative image is placed on a surface of a light transmission sheet carrying a photosensitive color-developing layer containing a photosensitive color-developing material which makes a color development in response to light. Further, as a second step, the light is applied thereto from the negative film side after the first step. As a result of the application of the light, a color development takes place in the photosensitive color-developing layer due to the light passing through the negative image, thus causing a positive image to be formed on the surface of the light transmission sheet.

16 Claims, 9 Drawing Sheets

METHOD FOR MANUFACTURING PATTERN SHEET FOR PLATE-MAKING

BACKGROUND OF THE INVENTION

1) Field of the Invention

The present invention relates to a method for manufacturing a pattern sheet for plate-making useful for manufacturing a stamp or the like, and more particularly to a method for manufacturing a pattern sheet for plate-making capable of easily forming a positive image through the use of a photographic negative film.

2) Description of the Related Art

So far, various printers such as a stamp have been used for printing a desired printing image such as a picture and a character on a print medium such as a post card. The Japanese Patent Publication No. 7-115532 discloses a stamp manufacturing method utilizing a portrait (person image) or the like. In such a stamp manufacturing method, a desired image such as a portrait is read out through a scanner or the like to produce a mesh spot photograph expressed by printing the densities of a photographic image in accordance with the sizes of mesh spots. Subsequently, a portrait partial photograph is formed by cutting out a display section such as a portrait from an image of the mesh spot photograph and a background partial photograph is made after cutting out the display section.

In addition, the portrait partial photograph is put on a transparent film and is printed on a positive film, thereby forming a portrait mesh positive film. On the other hand, the background partial photograph is put on a transparent film and the transparent film is placed upside down and is printed on a negative film, thereby producing a background image film in which the cut-out section (the section from which the portrait is cut out) in the background partial photograph is true black. Thereafter, the portrait mesh positive film is pilled up on a photosensitive resin plate and exposed to light to produce a portrait resin plate, and further, the background film is placed upside down and is placed on another photosensitive resin plate and exposed to light to form a background resin plate.

In the case of such a stamp manufacturing method, the portrait resin plate and the background resin plate are used as pattern sheet for plate-making, and they are uniformly heated and are alternately brought into contact with the surface of a foamed resin plate, thereby manufacturing a stamp.

Furthermore, a method disclosed in Japanese Patent Application Laid-Open Nos. 8-118771 and 8-207409 can also manufacture a stamp through the use of an image such as a portrait. A pattern sheet for plate-making used in this stamp manufacturing method is expressed according to the densities of the desired portrait on the basis of the differences between the dot concentrations in a manner that a photograph including a desired portrait is copied onto paper, a film or the like, through which an infrared ray passes, by means of a PPC copying machine. In addition, the densities of the portrait based upon the dot concentration differences are expressed with a recording material such as an ink or a toner which absorbs or intercepts infrared rays.

However, in the case of the former of the above-mentioned prior stamp manufacturing methods, a problem arises in that there is a need to produce two kinds of pattern sheets for plate-making: one being the portrait resin plate made through the use of the portrait mesh positive film and the other being the background resin plate made through the use of the background film. In addition, for manufacturing a stamp, it is necessary to use two kinds of these pattern sheets for plate-making, and therefore, a plurality of steps are required for producing the pattern sheets for plate-making and for manufacturing the stamp, with the result that the stamp manufacturing method becomes complicated.

Moreover, because of manufacturing the stamp by alternately bringing the portrait resin plate and the background resin plate into contact with the surface of the foamed resin plate, the stamp surface corresponding to the portrait section and the stamp surface corresponding to the background section are overlapped with each other on the surface of the foamed resin plate, which causes the printed images made at the stamp sealing to become indistinct.

On the other hand, in the case of the latter of the above-mentioned prior stamp manufacturing methods, the pattern sheet for plate-making is formed through the use of the PPC copying machine. However, the PPC copying machine has not been popularized into average homes yet, and hence, they have to use a PPC copying machine installed in companies, schools, convenience stores or the like on all such occasions. In addition, since the pattern sheet for plate-making is produced by PPC-copying a photograph or the like, there is a possibility of the deterioration of the image quality of the pattern sheet for plate-making and the print image quality of the plate-made stamp.

SUMMARY OF THE INVENTION

Accordingly, the present invention has been developed in order to eliminate the above-mentioned problems, and it is therefore an object of this invention to provide a method for manufacturing a pattern sheet for plate-making which is capable of easily forming a positive image through the use of a photographic negative film.

According to a first aspect of the present invention, there is provided a method for manufacturing a pattern sheet for plate-making, where the method comprises a first step of placing a negative film with a printed negative image on a surface of a light transmission sheet carrying a photosensitive color-developing layer containing a photosensitive color-developing material which makes a color development in response to light, to form a laminate, and a second step of applying the light to the laminate formed in the first step from the negative film side to make a color development in the photosensitive color-developing layer by the light passing through the negative image so that a positive image is formed on the surface of the light transmission sheet.

According to the method according to the first aspect of this invention, in the first step, a negative film is placed on the surface of the light transmission sheet having the photosensitive color-developing layer thereon.

Further, in the second step, the light applied from the negative film side passes through the negative image of the negative film to reach the photosensitive color-developing layer of the light transmission sheet. Thereafter, the photosensitive color-developing material contained in the photosensitive color-developing layer produces the color development owing to the light passing through the negative film, so that the positive image is formed on the surface of the light transmission sheet, thus manufacturing a pattern sheet of plate-making. Thus, the pattern sheet for plate-making with a positive image is easily producible through the use of a negative film.

According to a second aspect of this invention, in the foregoing method for manufacturing a pattern sheet for plate-making according to the first aspect of the invention, an ultraviolet ray is employed as the light, and a photochromic coating (paint) is used for the aforesaid photosensitive color-developing material. This pattern sheet manufacturing method can fulfill the same effects as those of the above-mentioned method according to the second aspect of this invention, besides, since the photochromic coating having a reversibility on variation in color development is used for the photosensitive color-developing material, when the ultraviolet ray is applied to the negative film laminated light transmission sheet, the photochromic coating makes a color development, such as blue, thereby manufacturing a pattern sheet for plate-making in which a positive image is formed on the light transmission sheet. Subsequently, if intercepting the ultraviolet ray and leaving the pattern sheet for plate-making as it is for a given period of time, the positive image on the pattern sheet for plate-making comes into a colorless condition, and the pattern sheet for plate-making becomes a light transmission sheet having the substantially same condition as that before the ultraviolet ray application. Accordingly, the recycling of the pattern sheet for plate-making once used becomes possible without throwing away.

Furthermore, in accordance with a third aspect of this invention, there is provided a method for manufacturing a pattern sheet for plate-making, where the method comprises a first step of interposing a heat-generating sheet, including a heat-generating material whose temperature rises by applying light thereto, between a surface of a light transmission sheet carrying a thermosensitive color-developing layer containing a thermosensitive color-developing material making a color development in response to heat and a negative film with a negative image printed thereon to make a laminate, and a second step of applying the light to the laminate formed in the first step from the negative film side to heat the heat-generating sheet by the light passing through the negative image so that the color development takes place in the thermosensitive color-developing layer coming into contact with the heated portion of the heat-generating sheet, thus forming a positive image on the light transmission sheet surface.

According to the method of the third aspect of this invention, in the first step, the heat-generating sheet is inserted into between the surface of the light transmission sheet having the thermosensitive color-developing layer thereon and the negative film in a laminated condition. Further, in the second step, the light applied from the negative film side passes through the negative image of the negative film to reach the heat-generating sheet, so that the heat-generating sheet is heated by the light to cause its heat-generating material to generate heat. In consequence, the thermosensitive color-developing layer is heated by the heat-generating material and the thermosensitive color-developing material reacts to make a heat development, so that a positive image is formed on the light transmission sheet to thereby manufacture a pattern sheet for plate-making. Accordingly, a pattern sheet for plate-making having a positive image is easily producible through the use of a negative film.

In accordance with a fourth aspect of this invention, there is provided a method for manufacturing a pattern sheet for plate-making comprises a first step of placing a negative film with a negative image printed thereon on a surface of a light transmission sheet equipped with a photosensitive curing layer made of a photosensitive curing material curing in response to light and having a light non-transmission characteristic after the cure, to form a laminate, and a second step of applying the light to the laminate formed in the first step from the negative film side to cure the photosensitive curing layer by the light passing through the negative image so that a positive image is formed on the light transmission sheet surface.

According to the method according to the fourth aspect of this invention, in the first step, the negative film is placed on the surface of the light transmission sheet having the photosensitive curing layer thereon. Further, in the second step, the light applied from the negative film side passes through the negative image of the negative film to reach the photosensitive curing layer of the light transmission sheet. Thereafter, the photosensitive curing material organizing the photosensitive curing layer is cured by the light passing through the negative film. Since, of the photosensitive curing layer, the cured portion has a light non-transmission characteristic, a positive image is formed on the light transmission sheet surface, so that a pattern sheet for plate-making is producible. Thus, a pattern sheet for plate-making having a positive image is easily producible through the use of a negative film.

In accordance with a fifth aspect of this invention, in the second step of the method according to the fourth aspect of this invention, there is included a removal process for removing, of the photosensitive curing layer, the photosensitive curing material not cured by the light. The method according to the fifth aspect of this invention works as well as the method according to the fourth aspect of this invention, and in addition, since, of the photosensitive curing layer, the photosensitive curing material free from curing by the light is removed from the surface of the pattern sheet of plate-making in the removal process, even if the light is applied in error onto the surface of the pattern sheet for plate-making already having a positive image thereon, it is possible to prevent the photosensitive curing material existing at a portion not having the positive image from being cured, whereupon the disappearance of the desired positive image is avoidable.

In accordance with a sixth aspect of this invention, in the method according to the fourth or fifth aspect of this invention, an ultraviolet ray is employed as the light, and a colored ultraviolet curing resin is used as the photosensitive curing material.

These and other objects, features and advantages of the present invention are described in or will become apparent from the following detailed description of the invention.

DESCRIPTION OF THE PREFERRED EMBODIMENTS

Preferred embodiments of the present invention will be described hereinbelow with reference to the accompanying drawings.

Figure 1A:
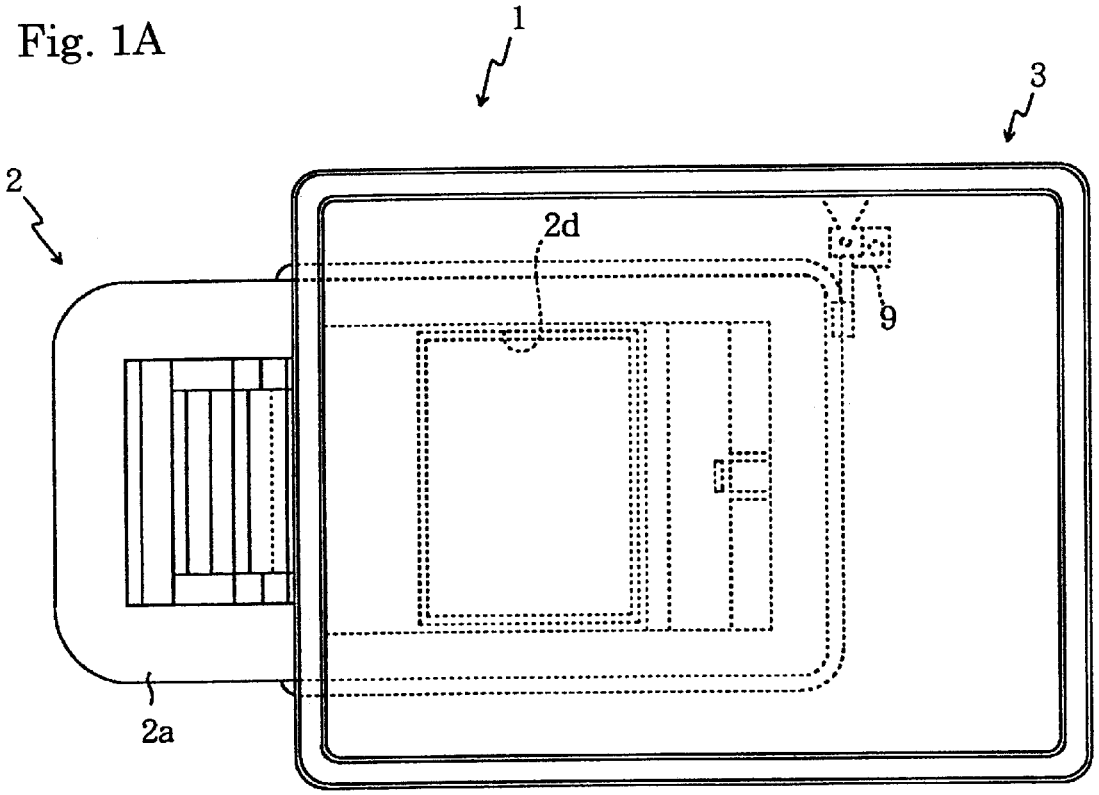
FIG. 1A is a top view showing a plate-making stamp unit for a stamp through the use of a stamp base board (stamp substrate) and a pattern sheet for plate-making manufactured by a method for manufacturing a pattern sheet for plate-making according to an embodiment of the present invention.
Figure 1B:
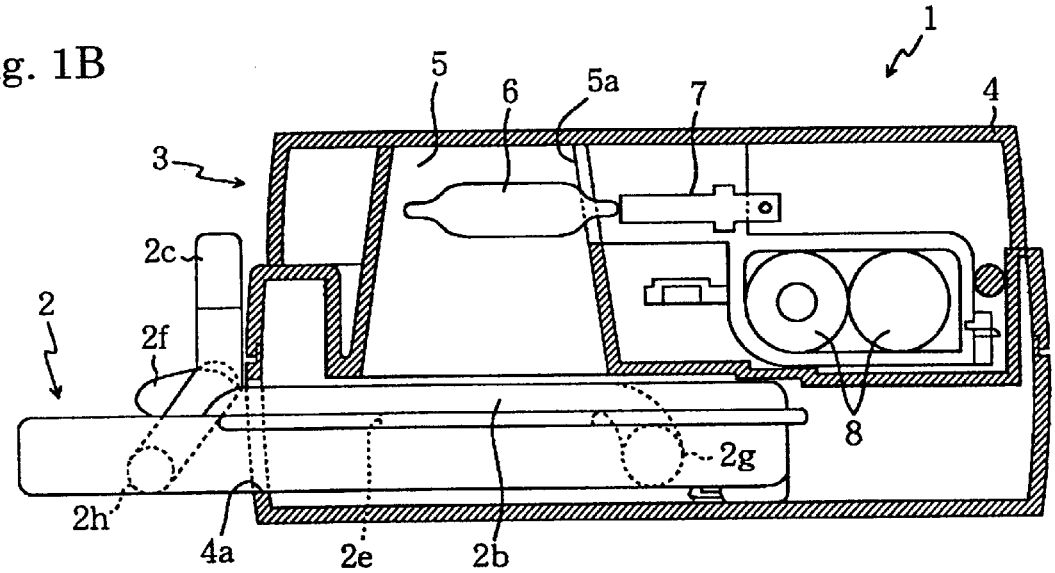
FIG. 1B is a side-elevational cross-sectional view showing the stamp unit of FIG. 1A.

FIG. 1A is a top view showing a stamp unit to be used for a method for manufacturing a pattern sheet for plate-making according to the present invention and used for producing a stamp through the use of the pattern sheet for plate-making, and FIG. 1B is a side-elevational cross-sectional view showing the stamp unit of FIG. 1A. Further, FIG. 2 is a perspective view showing a tray 2 in a state where its transparent movable cover 2*b* is open, and FIG. 3 is a perspective view showing the tray 2 in a state where its transparent movable cover 2*b* is in a closed condition and further showing a unit body 3 from which the tray 2 is taken out.

A stamp unit, generally designated at numeral 1, is equipped with a tray 2 for receiving a pattern sheet for plate-making such as a photochromic film 11, which will be described herein later, a stamp base member 13 and others, and a unit body 3 for storing the tray 2 therein to produce a pattern sheet for plate-making and a stamp.

Figure 2:
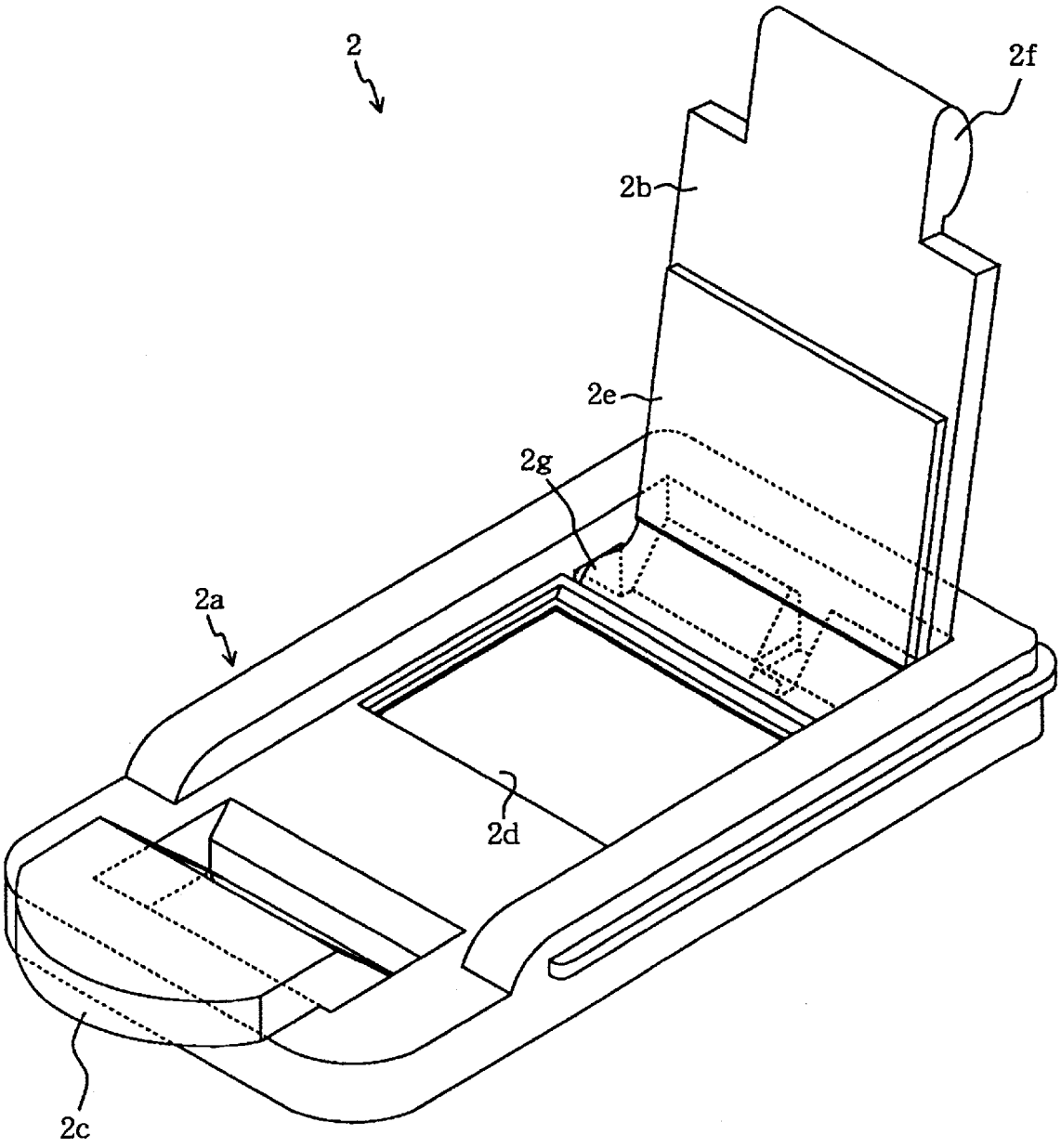
FIG. 2 is a perspective view showing a tray in a state where its transparent movable cover is open.
Figure 3:
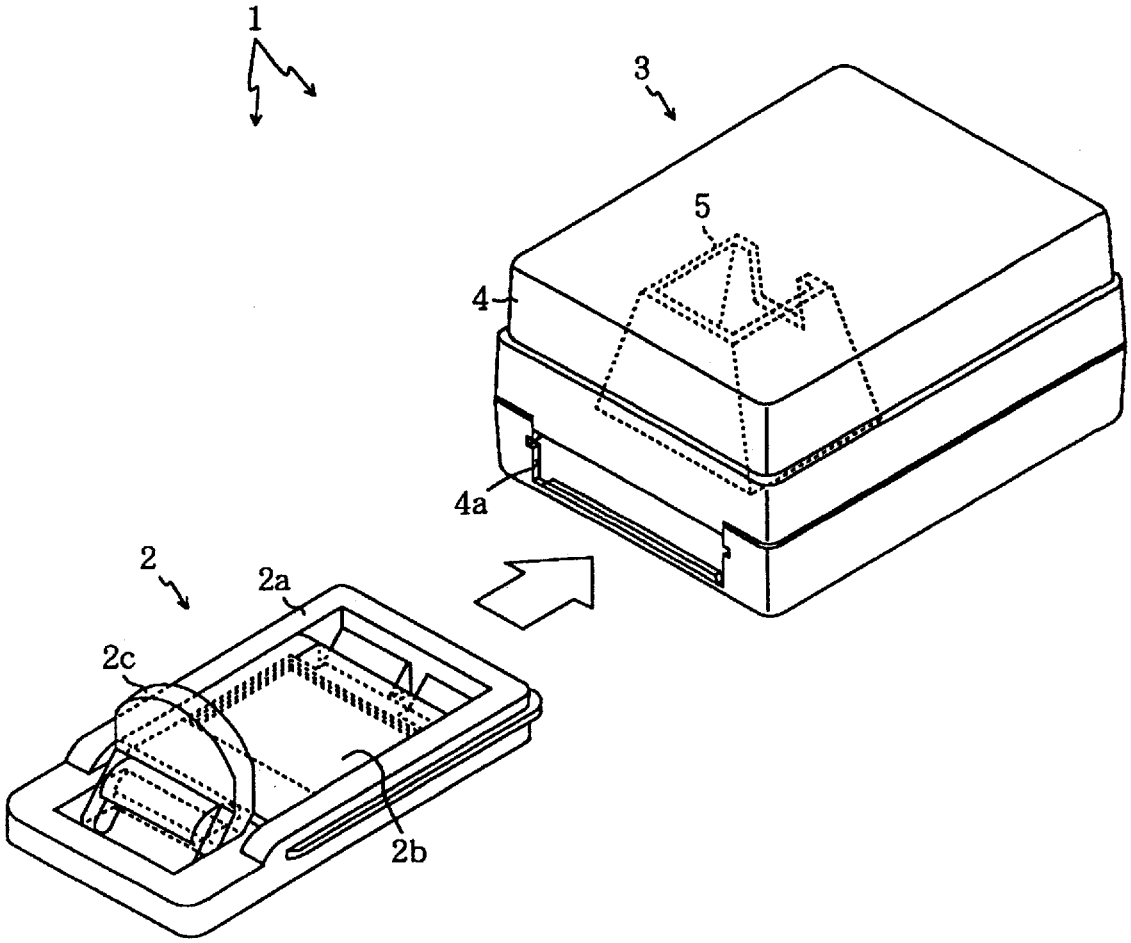
FIG. 3 is a perspective view showing the tray in a state where its transparent movable cover is closed and further showing a unit body from which the tray is taken out.

As shown in FIG. 2, the tray 2 includes a tray body 2*a*, a transparent movable cover 2*b* and an engaging member 2*c*. In a substantially central portion of the tray body 2*a*, made is a recess section 2*d* having a substantially rectangular configuration in plane. Placed in this recess section 2*d* are a negative film 12, which will be mentioned herein later, a pattern sheet for plate-making such as a photochromic film 11, a stamp base board 13 and others. To one side of this tray body 2*a*, the transparent movable cover 2*b* is pivotally attached through a pivot pin 2*g* to be openable and closable, and to the other side thereof, an engaging member 2*c* for establishing the engagement of the transparent movable cover 2*b* in the closed condition with the tray body 2*a* is disposed through a pivot pin 2*h* to be rotatable. The transparent movable cover 2*b* is made of a transparent acrylic resin having a light transmission property, and a pressing section 2*e* is formed integrally with a lower surface of the transparent movable cover 2*b* to press the negative film 12, which will be mentioned herein later, the pattern sheet for plate-making such as the photochromic film 11, the stamp base board 13 and others in a laminated condition against the bottom surface of the recess section 2*d*. In addition, an engaging section 2*f* for connection or disconnection to or from the engaging section 2*c* is formed integrally on the free-end side of the transparent movable cover 2*b*.

As shown in FIGS. 1A and 1B, the unit body 3 is composed of a hollow-box-like case 4. Below a left-hand wall of this case 4 (on the left-hand side in FIG. 1B) there is made an insertion opening 4*a* through which the tray 2 can be stored or taken out into or from the interior of the unit body 3. Made at an upper portion of the case 4 is a rectangular trapezoidal recess section 5 having a substantially rectangular configuration in plane, and adhered to each of side wall surfaces of the recess section 5 is a sheet (not shown) such as an aluminum foil excellent in light reflection characteristic. In addition, a flashing bulb 6 is detachably placed on one side wall 5*a* of the recess section 5, and a contact member 7 is disposed at a right-hand portion of the flashing bulb 6.

To this contact member 7, there is connected a dry battery 8 serving as a power supply to make the flashing bulb 6 flash. Further, a switch unit 9 is located in the vicinity of one inner wall of the case 4, and when the tray 2 is inserted through the insertion opening 4*a* to be accommodated within the interior of the unit body 3, the switch unit 9 operates to come into an ON state so that a power is supplied from the dry battery 8 to the flashing bulb 6 to make the flashing bulb 6 flash.

Figure 4A:
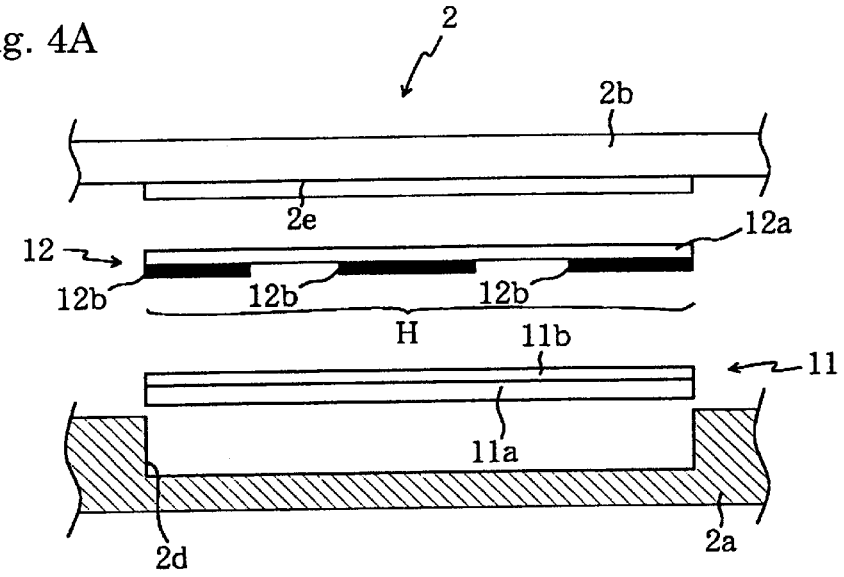
FIG. 4A is a cross-sectional view showing bases in a laminated condition based upon a method for manufacturing a pattern sheet for plate-making according to a first embodiment of this invention.
Figure 4B:
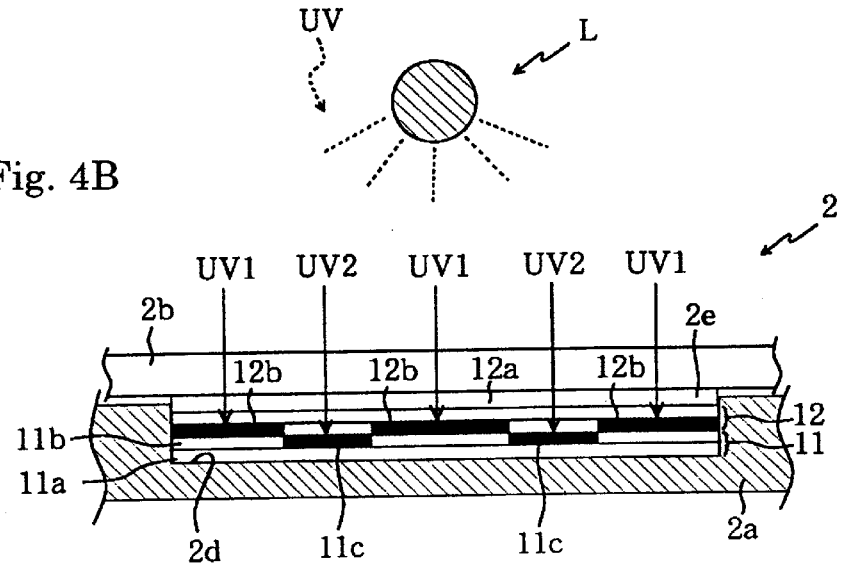
FIG. 4B is a cross-sectional view showing the laminate of the bases at the application of light.
Figure 4C:
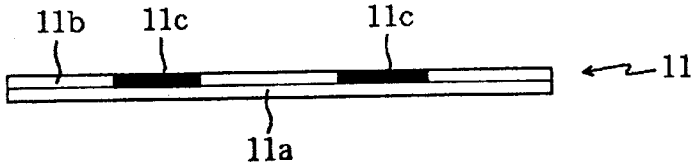
FIG. 4C is a cross-sectional view showing a photochromic film on which a positive image is formed.
Figure 4D:
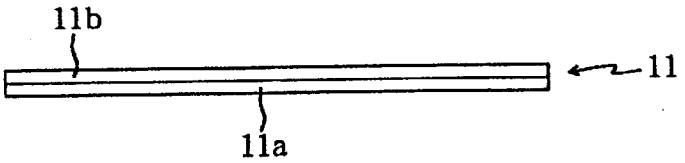
FIG. 4D is a cross-sectional view showing the photochromic film after the elapse of a given period of time from the interception of an ultraviolet ray.

Secondly, a description will be taken hereinbelow of a method for manufacturing a pattern sheet for plate-making based upon this stamp unit 1. FIG. 4A is a cross-sectional view showing bases in a laminated condition in the method for manufacturing a pattern sheet for plate-making, FIG. 4B is a cross-sectional view showing the laminate of the bases at the application of light, FIG. 4C is a cross-sectional view showing the photochromic film 11 on which formed is a positive image, and FIG. 4D is a cross-sectional view showing the photochromic film 11 after the elapse of a given period of time from the interception of an ultraviolet ray.

As shown in FIG. 4A, the photochromic film 11 comprises a transparent sheet 11*a* serving as a base and a photochromic layer 11*b* formed on the transparent sheet 11*a*. The transparent sheet 11*a* is made of a synthetic resin such as a PET (polyethylene terephthalate), a vinyl chloride and an ABS resin, and is shaped into a transparent sheet-like configuration with a substantially uniform thickness. Further, the transparent sheet 11*a* has a property of being molten at a temperature higher than the melting point (for example, in the case of a soft polyurethane-based resin, approximately 120° C., and in the case of a soft polyolefin-based resin, approximately 70° C.) of the stamp base board 13 which will be described herein later. For instance, the melting point of the transparent sheet 11*a* made of a PET is approximately 230° C. Accordingly, in the case of placing the photochromic film 11 on the stamp base board 13 in a laminated condition and of heating them, even if the stamp base board 13 is heated to be molten, the photochomic film 11 is free from being molten.

The photochromic layer 11*b* is a thin film formed on the upper surface of the transparent sheet 11*a*, and is formed to have a substantially uniform thickness in a manner of impregnating or applying an organic photochromic ink (manufactured by Teikoku Ink Co., Ltd.) into or onto the upper surface of the transparent sheet 11*a*. This photochromic ink is generally a colorless and transparent ink, and has a property of developing blue color when receiving an ultraviolet ray (see FIG. 4C). In addition, when intercepting the application of the ultraviolet ray to the photochromic ink and leaving the photochromic ink as its is for a given period of time, the photochromic ink turns to a colorless and transparent condition, thereby returning to the state taken before the application of the ultraviolet ray (see FIG. 4D).

The negative film 12 is a well-known monochrome negative film on which printed is a desired negative image H such as a portrait. This negative film 12 is made up of a light transmission film base 12*a* and a light non-transmission member 12*b* formed on the surface of the film base 12*a*. The light non-transmission member 12*b* is made such that a photosensitive material such as silver halide is sensitive to light and reduced by a developer into a metallic silver. The aforesaid negative image H is formed with the light transmission film base 12*a* and the light non-transmission member 12*b*.

Subsequently, as shown in FIG. 3, the tray 2 is taken out from the unit body 3, and the engaging member 2*c* and the engaging section 2*f* of the transparent movable cover 2*b* are released from the engaging condition to make the transparent movable cover 2*b* of the tray 2 open (see FIG. 2). In a state where the transparent movable cover 2*b* is in the open condition, the photochromic film 11 is placed on the bottom surface of the recess section 2*d* of the tray 2 in a manner that the transparent sheet 11*a* takes the lower position. Then, the light non-transmission member 12*b* side of the negative film 12 is placed on the upper surface of the photochromic layer 11*b* of the photochromic film 11 in a contacting condition. Thereafter, the transparent movable cover 2*b* is closed and the engaging member 2*c* is engaged with the engaging section 2*f*, so that the upper surface of the negative film 12 is pressed by the pressing section 2*e* of the transparent movable cover 2*b* (see FIGS. 3 and 4B). Following this, light including ultraviolet rays UV, emitted from a light source L such as the sun and an ultraviolet lamp, is applied from the closed transparent movable cover 2*b* side of the tray 2 for a given period of time.

As shown in FIG. 4B, upon the application of the light including the ultraviolet rays UV from the light source L, the ultraviolet rays UV of the light components passes through, of the negative film 12, the film base 12*a* with no formed light non-transmission member 12*b*, and reaches the photochromic layer 11*b* of the photochromic film 11. On the other hand, the ultraviolet ray UV1 applied to the light non-transmission member 12*b* of the negative film 12 is intercepted by the light non-transmission member 12*b*.

Thus, in the photochromic layer 11*b* of the photochromic film 11, since the ultraviolet ray UV1 is not applied to the portion corresponding to the light non-transmission member 12*b* of the negative film 12, the photochromic ink in this portion does not react. On the contrary, since the ultraviolet ray UV2 comes to the portion corresponding to other than the light non-transmission member 12*b* of the negative film 12, the photochromic ink in this portion reacts to develop blue, so that a light non-transmission section 11*c* refusing the transmission of light is formed on the surface of the photochromic film 11 (see FIG. 4C). As a result, a positive image corresponding to the desired negative image H such as a portrait printed on the negative film 12 is formed on the surface of the photochromic film 11, thus manufacturing a pattern sheet for plate-making (see FIG. 4C).

If intercepting the application of the ultraviolet ray to the photochromic film 11 with the formed positive image and leaving the photochromic film 11 for a given period of time, the photochromic layer 11*b* of the photochromic film 11 gradually varies from blue toward a colorless and transparent condition, thus returning to the state before the application of the ultraviolet ray (see FIG. 4D). Accordingly, the recycling of the pattern sheet for plate-making using the photochromic film 11 is possible without throwing it away after use. For instance, the photochromic film 11 once used as a pattern sheet for plate-making can again be used as a pattern sheet for plate-making in a manner that, after being allowed to stand for a given period time, a negative film with another negative image printed thereon is placed in a laminated condition and light including an ultraviolet ray is applied thereto. Further, this photochromic film 11 can be recycled many times as long as the property of the photochromic ink does not deteriorate.

Figure 5A:
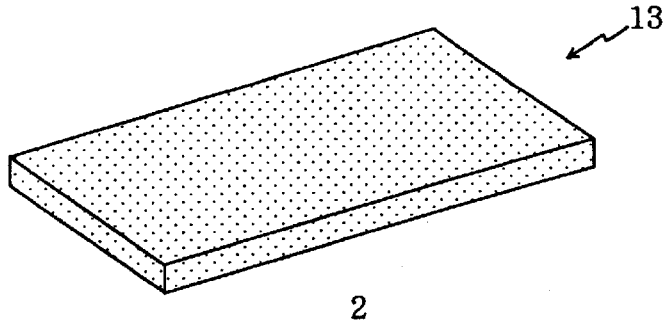
FIG. 5A is a perspective view showing a stamp base board before plate-making.
Figure 5B:
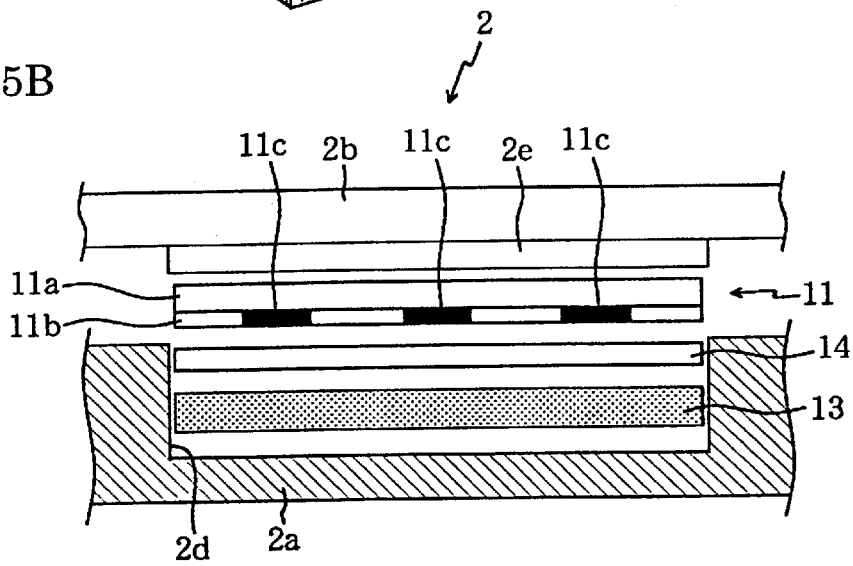
FIG. 5B is cross-sectional view for describing the laminating order of the base materials in a stamp plate-making operation using a pattern sheet for plate-making based upon a photochromic film.
Figure 5C:
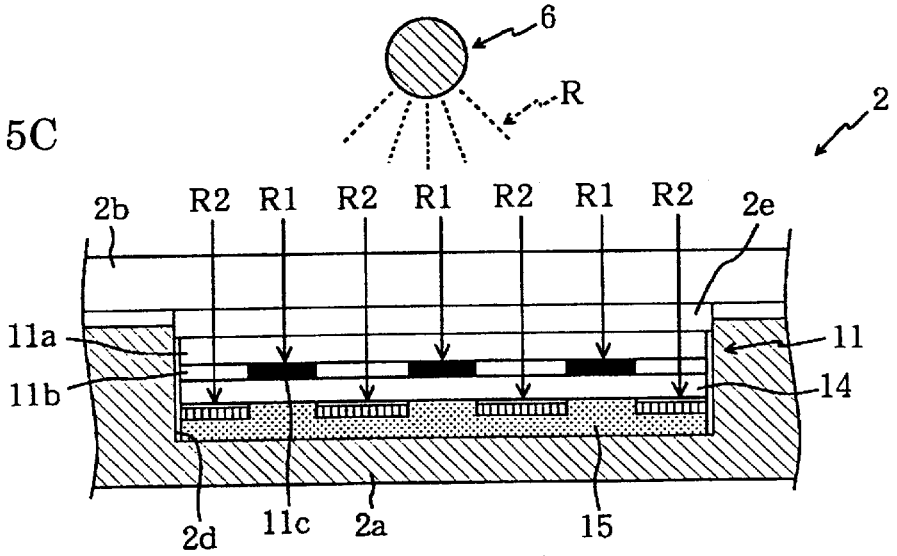
FIG. 5C is a cross-sectional view showing the bases at the application of light.
Figure 5D:
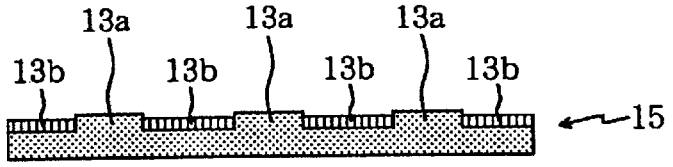
FIG. 5D is a cross-sectional view showing a stamp after plate-making.

Moreover, referring to FIGS. 3 and 5A to 5D, a description will be made hereinbelow of a stamp plate-making method using a pattern sheet for plate-making based upon the photochromic film 11 thus produced, and of a structure of the stamp base board 13. FIG. 5A is a perspective view showing the stamp base board 13 before plate-making, FIG. 5B is a cross-sectional view showing the laminating sequence of the bases and others in a stamp plate-making operation, FIG. 5C is a cross-sectional view showing the bases at the application of light, and FIG. 5D is a cross-sectional view showing a stamp 15 after plate-making.

As shown in FIG. 5A, the stamp base board 13 is made of, for example, a foam resin material such as a polyolefin-based resin, a polyvinylchloride-based resin and a polyurethane-based resin which has continuous foams and a porosity whereby a stamp ink can be impregnated, and when formed into a porous sheet, it has a flexibility (soft property). Thus, since the stamp 15 made by using the stamp base board 13 has the soft property, when printing, an excellent touch feeling is obtainable, and further, a vivid printed image is attainable. This stamp base board 13 contains carbon particles or the like in a dispersed condition, and is made to have a substantially uniform thickness of approximately 1 mm to approximately 5 mm.

Since this stamp base board 13 contains the carbon or the like, due to an infrared ray included in light applied to the surface side of the stamp base board 13, the carbon or the like is heated so that the self heat generation takes place, and hence, the surface of the stamp base board 13 is molten to close the exposed voids or pores. Thus, when the surface side of the stamp base board 13 is molten and cured in a state of being compressed, that portion acts as an ink non-exuding portion. On the other hand, the non-molten portion serves as an ink-exuding portion where the voids appear on the surface.

In this embodiment, in terms of the weight rate of the carbon or the like, contained in the stamp base board 13, to a polyurethane-based foam resin, the percentage content of the carbon assumes 1.0% by weight to 1.5% by weight. The carbon percentage content is not limited within this range, it is acceptable if the carbon percentage content is within a range of 0.1% by weight to 15% by weight. If exceeding the 15% by weight, the stamp base board 13 itself turns black so that it is very difficult to identify the color of the applied stamp ink, and even, it is difficult to know whether the stamp ink is applied or not. On the other hand, if being below 0.1% by weight, the sufficient heat generation does not occur to make it difficult to melt the surface of the stamp base board 13.

The transparent PET sheet 14 has a property of being molten at a temperature higher than the melting point (for example, in the case of a soft polyurethane-based resin, approximately 120° C., and in the case of a soft polyolefin-based resin, approximately 70° C.) of the stamp base board 13. That melting point is about 230° C. In addition, the thickness of the transparent PET sheet 14 reaches approximately 0.025 mm to approximately 0.2 mm. Accordingly, in the case that light is applied to the transparent PET sheet 14 and the stamp base board 13 which are in a laminated condition, the stamp base board 13 is molten by its self heat generation, but the transparent PET sheet 14 is free from being molten.

Furthermore, as shown in FIG. 3, the tray 2 is taken out from the unit body 3, and the engaging member 2*c* and the engaging section 2*f* of the transparent movable cover 2*b* are released from the engaging condition so that the transparent movable cover 2*b* of the tray 2 is set to the open condition (see FIG. 2). The stamp base board 13 is placed within the recess section 2*d* of the tray 2 whose transparent movable cover 2*b* is in the open condition, and the transparent PET sheet 14 is placed on the upper surface of the stamp base board 13, and further, the photochromic layer 11*b* of the photochromic film 11 is placed on the upper surface of the transparent PET sheet 14 in a laminated condition. Thereafter, the transparent movable cover 2*b* is closed and the engaging member 2*c* is engaged with the engaging section 2*f*, so that the upper surface of the photochromic film 11 is pressed by the pressing section 2*e* of the transparent movable cover 2*b* (see FIGS. 3 and 5C). Subsequently, the tray 2 whose transparent movable cover 2*b* is in the closed condition is inserted through the insertion opening 4*a* into the interior of the unit body 3. When the tray 2 is completely stored within the unit body 3, the switch unit 9 operates to come into the ON state, whereby the flashing bulb 6 flashes in response to the power fed from the dry battery 8 serving as a power source.

As shown in FIG. 5C, when the flashing bulb 6 flashes, the infrared rays R of the light components pass through the transparent movable cover 2*b*, the transparent sheet 11*a* of the photochromic film 11 and the transparent PET sheet 14, and then reach the upper surface of the photochromic layer 11*b*. At this time, the infrared ray R1 applied to the light non-transmission section 11*c* of the photochromic layer 11*b* is intercepted by the light non-transmission section 11*c*, whereas the infrared ray R2 applied to the portion of the photochromic layer 11*b* other than the light non-transmission section 11*c* passes through the photochromic layer 11*b*. Whereupon, in the stamp base board 13, since the infrared ray R1 does not reach the portion corresponding to the light non-transmission section 11*c* of the photochromic film 11, the carbon or the like in this portion does not show the heat generation. On the contrary, since the infrared ray R2 is applied to the portion corresponding to other than the light non-transmission section 11*c* of the photochromic film 11, the heat generation occurs in the carbon or the like in this portion.

In consequence, in the surface of the stamp base board 13 which comes into contact with the photochromic film 11, because the carbon or the like does not show the heat generation in the portion corresponding to the light non-transmission section 11*c* of the photochromic layer 11*b*, the ink exuding section 13*a* is formed in a state of having the continuous voids as they are. On the other hand, in the portion corresponding to other than the light non-transmission section 11*c*, the carbon or the like shows the heat generation, so that its surface is heated and molten to form the non-exuding section 13*b* where the continuous voids are closed, thus manufacturing the stamp 15 shown in FIG. 5D.

Incidentally, due to the infrared ray R1 applied in the direction of the transparent movable cover 2*b*, the light non-transmission section 11*c* is heated to rise in temperature so that the heat generation takes place. However, since the light non-transmission section 11*c* is placed into contact with the transparent PET sheet 14, the heat accumulated in the light non-transmission section 11*c* is transferred to the transparent PET sheet 14, thereby resulting in radiation. For this reason, in the stamp base board 13, the carbon or the like in the portion corresponding to the light non-transmission section 11*c* of the photochromic layer 11*b* does not show the heat generation, and therefore, the ink exuding section 13*a* can be formed in a state of having the continuous voids as they are.

Figure 6A:
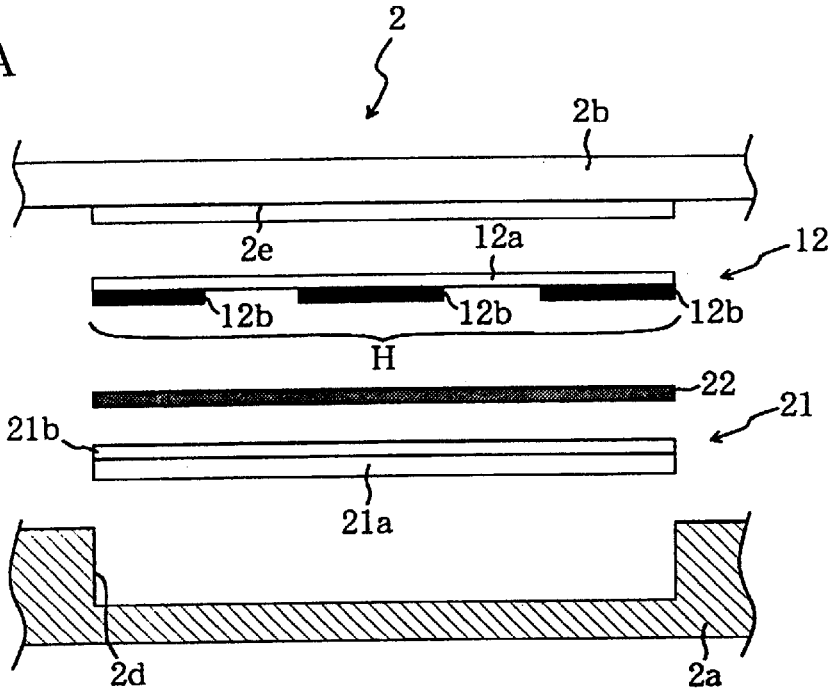
FIG. 6A is a cross-sectional view for describing the laminating order of bases in a method for manufacturing a pattern sheet for plate-making according to a second embodiment of this invention.
Figure 6A:
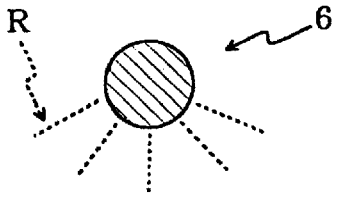
Figure 6B:
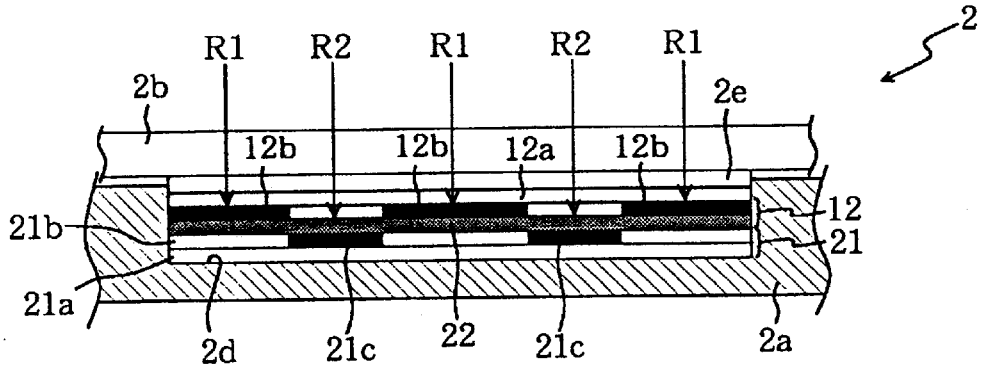
FIG. 6B is a cross-sectional view showing the laminate of the bases at the application of light.
Figure 6C:
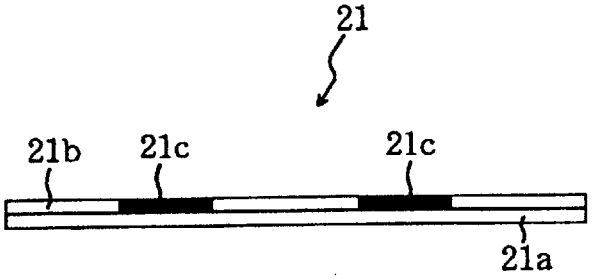
FIG. 6C is a cross-sectional view showing a thermal PET film on which a positive image is formed.

Furthermore, referring to FIGS. 6A to 6C, a description will be made hereinbelow of a method for manufacturing a pattern sheet for plate-making according to a second embodiment of this invention. In the second embodiment, a thermal PET film 21, which will be described herein later, is employed instead of the photochromic film 11 used as the pattern sheet for plate-making in the first embodiment. FIG. 6A is a cross-sectional view showing the laminating order of bases and others in the method for manufacturing a pattern sheet for plate-making, FIG. 6B is a cross-sectional view showing the laminate of the bases at the application of light, and FIG. 6C is a cross-sectional view showing a thermal PET film 21 on which formed is a positive image. The same parts as those in the first embodiment are marked with the same numerals, and the description thereof will be omitted for brevity, except the different parts.

The thermal PET film 21 is, as shown in FIG. 6A, composed of a transparent sheet 21*a* and a thermosensitive layer 21*b* formed on the upper surface of the transparent sheet 21*a*. The transparent sheet 21*a* is made of a synthetic resin such as a PET (polyethylene terephthalate), and has a transparent sheet-like configuration with a substantially uniform thickness. Further, the transparent sheet 21*a* has a property of being molten at a temperature higher than the melting point (for example, in the case of a soft polyurethane-based resin, approximately 120° C., and in the case of a soft polyolefin-based resin, approximately 70° C.) of the stamp base board 13. For instance, the melting point of the transparent sheet 21*a* made of the PET is about 230° C. Accordingly, in the case that the thermal PET film 21 and the stamp base board 13 are placed in a laminated condition and heated, even if the stamp base board 13 is molten by the heating, the thermal PET film 21 is free from being molten.

The thermosensitive layer 21*b* is formed, in the shape of a thin film having a substantially uniform thickness, on the upper surface of the transparent sheet 21*a* by impregnating or applying a color former, as applied onto the surface of a well-known thermosensitive paper, into or onto the upper surface of the transparent sheet 21*a*, respectively. This color former is made by finely dispersing a colorless coloring matter and a phenol compound or the like in a binder and, when heated, is molten at only the heated portion thereof so that the colorless coloring matter and the phenol compound or the like are mixed, whereby the color development takes place.

The heat sheet 22 has a property that it generates heat when irradiated with an infrared ray and has a substantially uniform thickness. The whole heat sheet 22 is colored in black with an ink, a toner or the like, and the carbon or the like contained in the ink, the toner or the like generates heat when being heated by the application of an infrared ray.

Still further, as shown in FIG. 3, the tray 2 is taken out from the unit body 3, and the engaging member 2*c* and the engaging section 2*f* of the transparent movable cover 2*b* are released from the engaging condition so that the transparent movable cover 2*b* of the tray 2 is set to its open condition (see FIG. 2). The heat sheet 22 is interposed between the light non-transmission member 12*b* side of the negative film 12 and the upper surface of the thermosensitive layer 21*b* of the thermal PET film 21 to make a laminated condition, and further, they are placed on the bottom surface of the recess section 2*d* of the tray 2, whose transparent movable cover 2*b* is in the open condition, in a state where the transparent sheet 21*a* of the thermal PET film 21 takes a lower position. Thereafter, the transparent movable cover 2*b* is closed and the engaging member 2*c* is engaged with the engaging section 2*f* so that the upper surface of the negative film 12 is pressed by the pressing section 2*e* of the transparent movable cover 2*b* (see FIGS. 3 and 6B). Following this, the tray 2 is inserted through the insertion opening 4*a* into the interior of the unit body 3 in a state where its transparent movable cover 2*b* is in the closed condition. When the tray 2 is completely inserted into the unit body 3, the switch unit 9 is put into operation to assume the ON state, so that the flashing bulb 6 flashes in response to the supply of the power from the dry battery 8 serving as a power source.

As shown in FIG. 6B, when the flashing bulb 6 flashes, the infrared rays R of the light components pass through, of the negative film 12, the film base 12*a* not having the formed light non-transmission member 12*b* thereon, finally reaching the heat sheet 22. On the contrary, the infrared ray R1 applied to the light non-transmission member 12*b* of the negative film 12 is intercepted by the light non-transmission member 12*b*. Whereupon, in the heat sheet 22, since the infrared ray R1 is not applied to the portion corresponding to the light non-transmission member 12*b* of the negative film 12, the carbon or the like contained in the ink, the toner or the like in this portion is free from being heated, thus not generating heat. On the other hand, since the infrared ray R2 is applied to the portion corresponding to that other than the light non-transmission member 12*b* of the negative film 12, the carbon or the like contained in the ink, the toner or the like existing in this portion is heated to generate heat.

As a result, the color former contained in the thermosensitive layer 21*b* of the thermal PET film 21 is heated and only the heated portion is molten, so that the colorless coloring matter and the phenol compound or the like are mixed to produce the color development (see FIG. 6C). Accordingly, the light non-transmission section 21*c* refusing the transmission of light is formed on the surface of the thermal PET film 21 (see FIG. 6C). A positive image corresponding to the desired negative image H such as a portrait printed on the negative film 12 is formed on the surface of the thermal PET film 21, thus manufacturing a pattern sheet for plate-making (see FIG. 6C).

Figure 7A:
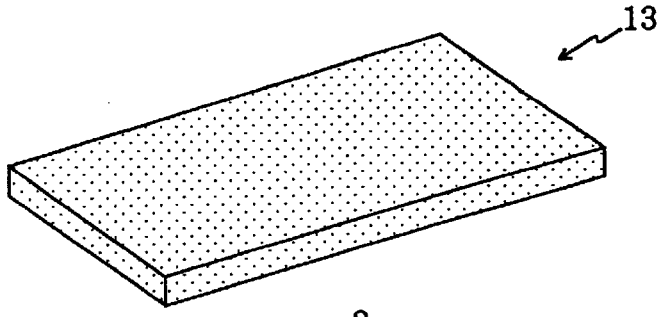
FIG. 7A is a perspective view showing a stamp base board before plate-making.
Figure 7B:
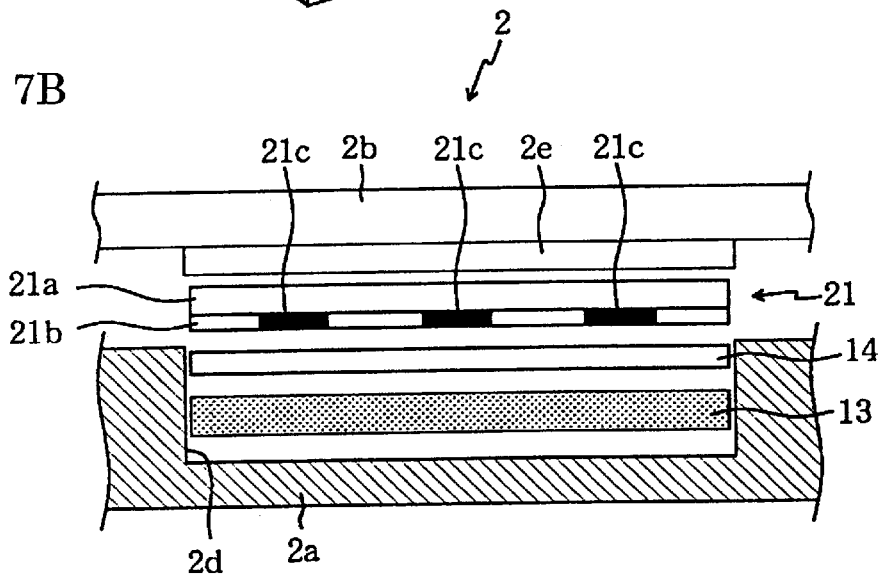
FIG. 7B is a cross-sectional view for describing the laminating order of the bases in a stamp plate-making operation using a pattern sheet for plate-making based upon a thermal PET film.
Figure 7C:
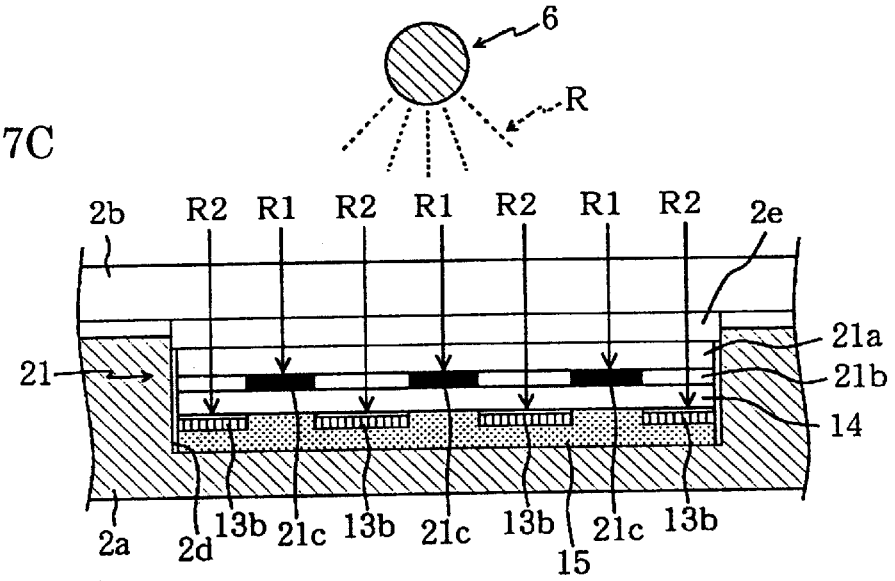
FIG. 7C is a cross-sectional view showing the bases at the application of light.
Figure 7D:
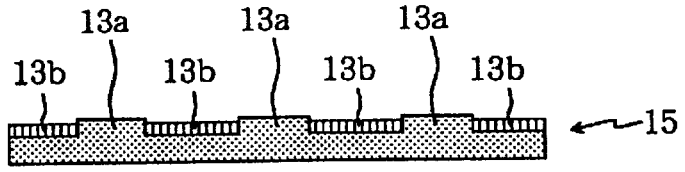
FIG. 7D is a cross-sectional view showing a stamp after plate-making.

Referring to FIGS. 3 and 7A to 7D, a description will be made hereinbelow of a stamp plate-making method using the pattern sheet for plate-making based upon the thermal PET film 21. FIG. 7A is a perspective view showing a stamp base board 13 before plate-making, FIG. 7B is a cross-sectional view showing the laminating sequence of the bases and others in a stamp plate-making operation, FIG. 7C is a cross-sectional view showing the bases at the application of light, and FIG. 7D is a cross-sectional view showing a stamp 15 after plate-making.

First, as shown in FIG. 3, the tray 2 is taken out from the unit body 3, and the engaging member 2*c* and the engaging section 2*f* of the transparent movable cover 2*b* are released from the engaging condition so that transparent movable cover 2*b* of the tray 2 is put into the open condition (see FIG. 2). The stamp base board 13 is mounted within the recess section 2*d* of the tray 2 taking the transparent movable cover 2*b* open condition, and the transparent PET sheet 14 is placed on the upper surface of the stamp base board 13, and further, the thermosensitive layer 21*b* of the thermal PET film 21 is brought into contact with the upper surface of the transparent PET sheet 14 in a laminated condition. Subsequently, in a way of the closing of the transparent movable cover 2*b* and the engagement between the engaging member 2*c* and the engaging section 2*f*, the upper surface of the thermal PET film 21 is pressed by the pressing section 2*e* of the transparent movable cover 2*b* (see FIGS. 3 and 7C). Then, the tray 2 in which the transparent movable cover 2*b* is in the closed condition is inserted through the insertion opening 4*a* into the interior of the unit body 3. Upon the complete insertion of the tray 2 into the unit body 3, the switch unit 9 operates to come into the ON state, so that the flashing bulb 6 flashes owing to the supply of the power from the dry battery 8 serving as a power supply.

As shown in FIG. 7C, when the flashing bulb 6 flashes, the infrared rays R of the light components pass through the transparent movable cover 2*b*, the transparent sheet 21*a* of the thermal PET film 21 and the transparent PET sheet 14 and finally reach the upper surface of the thermosensitive layer 21*b*. The infrared ray R1 applied to the light non-transmission section 21*c* of the thermosensitive layer 21*b* is intercepted by that light non-transmission section 21*c*. Whereupon, in the stamp base board 13, the infrared ray R1 is not applied to the portion corresponding to the light non-transmission section 21*c* of the thermal PET film 21, and hence, the heat generation of the carbon or the like in this portion does not take place. On the contrary, since the infrared ray R2 comes to the portion corresponding to other than the light non-transmission section 21*c* of the thermal PET film 21, the heat generation of the carbon or the like in this portion takes place.

In consequence, in the surface of the stamp base board 13 which is brought into contact with the thermal PET film 21, the heat generation of the carbon does not occur in the portion corresponding to the light non-transmission section 21*c* of the thermosensitive layer 21*b*, and therefore, the ink exuding section 13*a* is formed in a state of having the continuous voids as they are. On the other hand, in terms of the portion corresponding to other than the light non-transmission section 21*c*, the carbon shows the heat generation, and hence, its surface is heated to be molten so that the continuous voids are closed to form the ink non-exuding section 13*b*, thereby manufacturing the stamp 15 shown in FIG. 7D.

Incidentally, due to the infrared ray R1 applied in the direction of the transparent movable cover 2*b*, the light non-transmission section 21*c* is heated to rise in temperature so that the heat generation takes place. However, since the light non-transmission section 21*c* is placed into contact with the transparent PET sheet 14, the heat accumulated in the light non-transmission section 21*c* is transferred to the transparent PET sheet 14, thereby resulting in radiation. For this reason, in the stamp base board 13, the carbon or the like in the portion corresponding to the light non-transmission section 21*c* of the thermosensitive layer 21*b* does not show the heat generation, and therefore, the ink exuding section 13*a* can be formed in a state of having the continuous voids as they are.

Figure 8A:
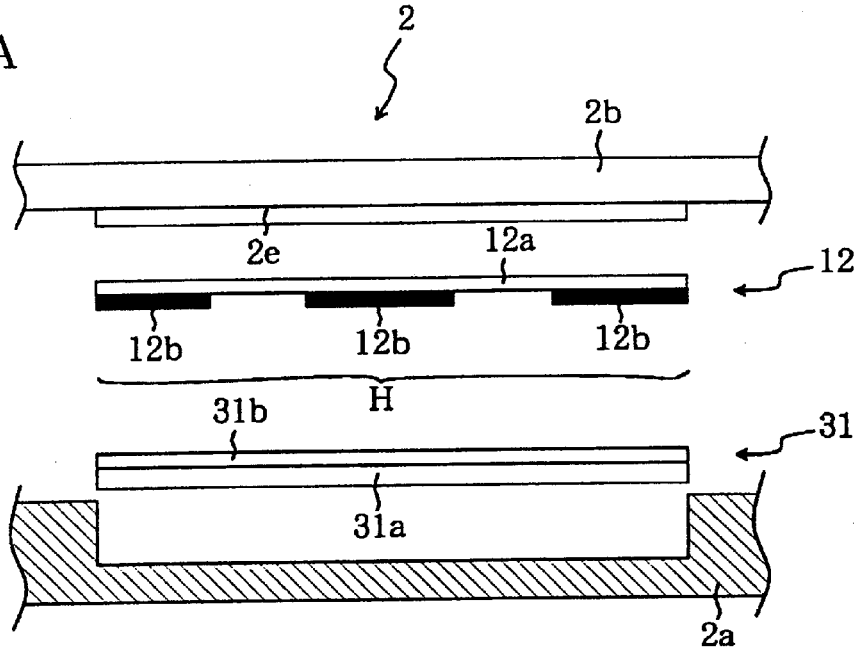
FIG. 8A is a cross-sectional view for describing the laminating sequence of bases in a method for manufacturing a pattern sheet for plate-making according to a third embodiment of this invention.
Figure 8B:
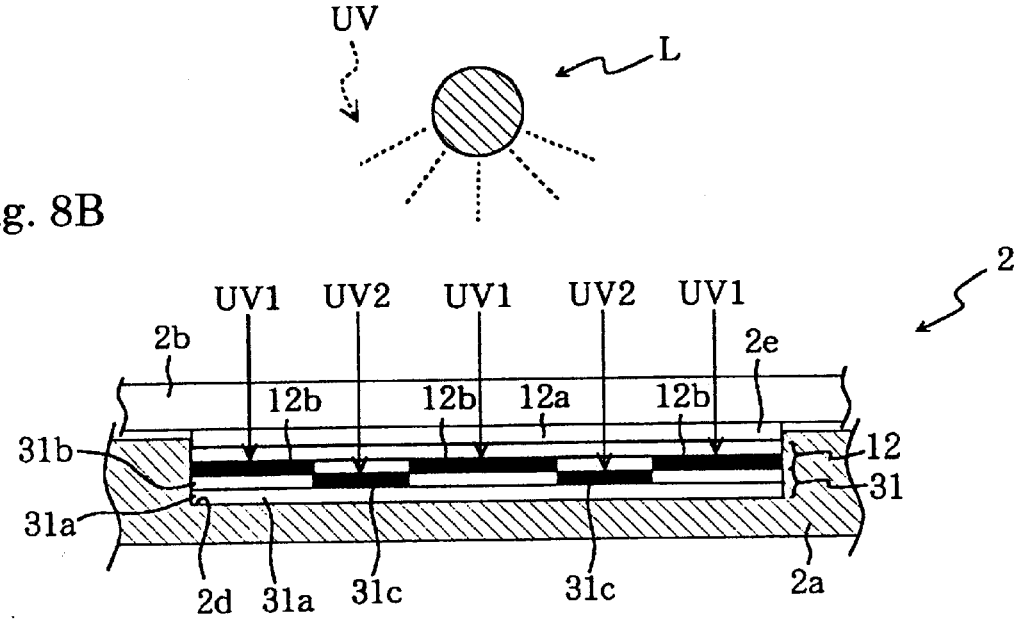
FIG. 8B is a cross-sectional view showing the laminate of the bases at the application of light.
Figure 8C:
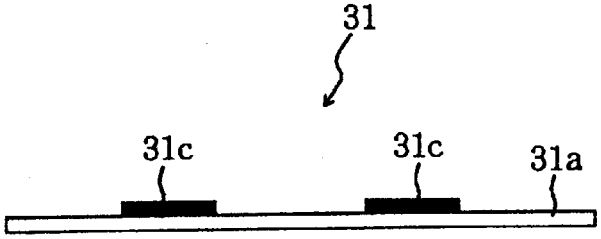
FIG. 8C is a cross-sectional view showing an ultraviolet curing film on which a positive image is formed.

Moreover, referring to FIGS. 8A to 8C, a description will be made hereinbelow of a method for manufacturing a pattern sheet for plate-making according to a third embodiment of this invention. In the third embodiment, an ultraviolet curing film 31, which will be described herein later, is employed in place of the photochromic film 11 used as the pattern sheet for plate-making in the first embodiment. FIG. 8A is a cross-sectional view showing the laminating sequence of bases or the like in a method for manufacturing a pattern sheet for plate-making, FIG. 8B is a cross-sectional view showing the laminate of the bases at the application of light, FIG. 8C is a cross-sectional view showing the ultraviolet curing film 31 on which formed is a positive image. The same parts as those in the first embodiment are marked with the same numerals, and the description thereof will be omitted for simplicity, except the different parts.

As shown in FIG. 8A, the ultraviolet curing film 31 carries a transparent sheet 31*a* serving as a base therefor and an ultraviolet curing layer 31*b* formed on the upper surface of the transparent sheet 31*a*. The transparent sheet 31*a* is made of a synthetic resin such as a PET (polyethylene terephthalate), and is shaped into a transparent sheet-like configuration with a substantially uniform thickness. In addition, the transparent sheet 31*a* has a property of being molten at a temperature higher than the melting point (for example, in the case of a soft polyurethane-based resin, approximately 120° C., and in the case of a soft polyolefine-based resin, approximately 70° C.) of the stamp base board 13. For instance, the melting point of the transparent sheet 31*a* made of a PET is approximately 230° C. Accordingly, in the case of placing the ultraviolet curing film 31 on the stamp base board 13 in a laminated condition and of heating them, even if the stamp base board 13 is heated to be molten, the ultraviolet curing film 31 is free from being molten.

The ultraviolet curing layer 31*b* is a thin film formed on the upper surface of the transparent sheet 31*a*, and is formed to have a substantially uniform thickness by impregnating or applying an ultraviolet curing resin into or onto the upper surface of the transparent sheet 31*a*. This ultraviolet curing resin has a property of being cured when irradiated with an ultraviolet ray. Further, a light non-transmission coloring matter in black, gold, silver, orange, white or a different color is impregnated or applied into or onto the ultraviolet curing resin constituting the ultraviolet curing layer 31*b*.

As shown in FIG. 3, the tray 2 is taken out from the unit body 3, and the engaging member 2*c* and the engaging section 2*f* of the transparent movable cover 2*b* are released from the engaging condition to make the transparent movable cover 2*b* of the tray 2 open (see FIG. 2). In a state where the transparent movable cover 2*b* is in the open condition, the ultraviolet curing film 31 is placed on the bottom surface of the recess section 2*d* of the tray 2 in a manner that the transparent sheet 31*a* takes the lower position. Then, the light non-transmission member 12*b* side of the negative film 12 is placed up on the upper surface of the ultraviolet curing layer 31*b* of the ultraviolet curing film 31 in a contacting condition. Thereafter, the transparent movable cover 2*b* is closed, and the engaging member 2*c* is engaged with the engaging section 2*f*, so that the upper surface of the negative film 12 is pressed by the pressing section 2*e* of the transparent movable cover 2*b* (see FIGS. 3 and 8B). Following this, light including ultraviolet rays UV, emitted from a light source L such as the sun and an ultraviolet lamp, is applied from the closed transparent movable cover 2*b* side of the tray 2 for a given period of time.

As shown in FIG. 8B, upon the application of the light including the ultraviolet rays UV from the light source L, the ultraviolet rays UV of the light components passes through the film base 12*a* with no formed light non-transmission member 12*b*, and reaches the ultraviolet curing layer 31*b* of the ultraviolet curing film 31. On the other hand, the ultraviolet ray UV1 applied to the light non-transmission member 12*b* of the negative film 12 is intercepted by the light non-transmission member 12*b*. Accordingly, in the ultraviolet curing layer 31*b* of the ultraviolet curing film 31, since the ultraviolet ray UV1 is not applied to the portion corresponding to the light non-transmission member 12*b* of the negative film 12, the ultraviolet curing resin in this portion is not cured. Meanwhile, since the ultraviolet ray UV2 comes to the portion corresponding to other than the light non-transmission member 12*b* of the negative film 12, the ultraviolet curing resin in this portion is cured in response to the ultraviolet ray UV2.

After this, the tray 2 is taken out from the unit body 3 and the ultraviolet curing film 31 mounted within the recess section 2*d* of the tray 2 is taken out, and further, the non-cured ultraviolet curing resin of the ultraviolet curing layer 31*b* is dissolved or removed from the ultraviolet curing layer 31*b* by using a solvent or by washing (see FIG. 8C). Since the cured ultraviolet curing layer 31*b* is colored with the coloring matter, a light non-transmission section 31*c* refusing the transmission of light is formed on the surface of the ultraviolet curing film 31 (see FIG. 8C). As a result, a positive image corresponding to a desired negative image H such as a portrait printed on the negative film 12 is formed on the surface of the ultraviolet curing film 31, thus manufacturing a pattern sheet for plate-making (see FIG. 8C).

Figure 9A:
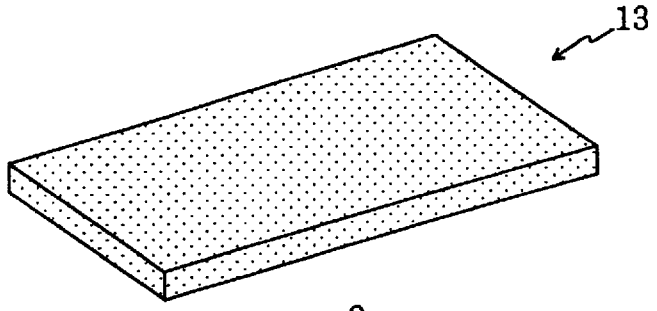
FIG. 9A is a perspective view showing a stamp base board before plate-making.
Figure 9B:
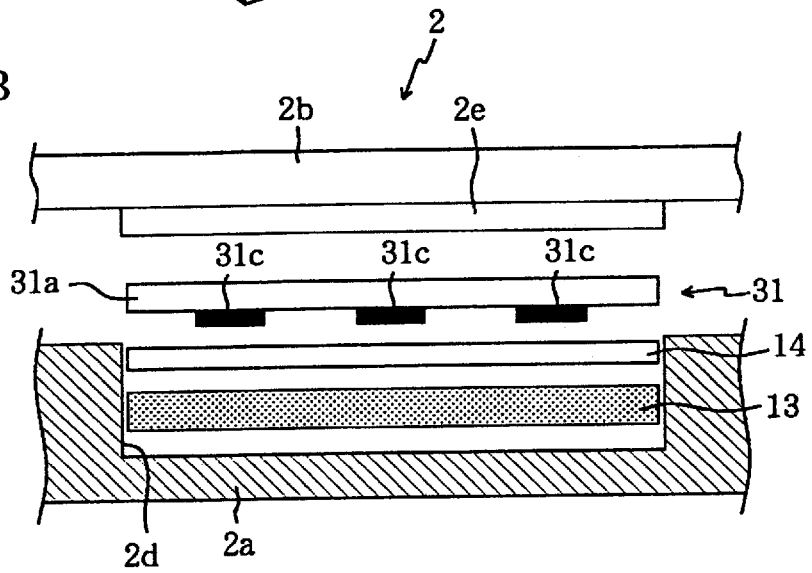
FIG. 9B is a cross-sectional view for describing the laminating sequence of the bases in a stamp plate-making operation using a pattern sheet for plate-making based upon an ultraviolet curing film.

Furthermore, referring to FIGS. 3 and 9A to 9D, a description will be taken hereinbelow of a stamp plate-making method using a pattern sheet for plate-making based upon the ultraviolet curing film 31. FIG. 9A is a perspective view showing a stamp base board 13 before plate-making, FIG. 9B is a cross-sectional view showing the laminating sequence of bases or the like in a stamp plate-making operation, FIG. 9C is a cross-sectional view showing the bases at the application of light, and FIG. 9D is a cross-sectional view showing a stamp 15 after plate-making.

First, as shown in FIG. 3, the tray 2 is taken out from the unit body 3, and the engaging member 2*c* and the engaging section 2*f* of the transparent movable cover 2*b* are released from the engaging condition so that the transparent movable cover 2*b* of the tray 2 is set to the open condition (see FIG. 2). In a state where the transparent movable cover 2*b* is in the open condition, the stamp base board 13 is mounted within the recess section 2*d* of the tray 2, and the transparent PET sheet 14 is placed on the upper surface of the stamp base board 13 in a laminated condition, and further, the ultraviolet curing layer 31*b* of the ultraviolet curing film 31 is brought into contact with the upper surface of the transparent PET sheet 14 to make a laminated condition. Thereafter, the transparent movable cover 2*b* is closed and the engaging member 2*c* is engaged with the engaging section 2*f*, so that the pressing section 2*e* of the transparent movable cover 2*b* presses the upper surface of the ultraviolet curing film 31 (see FIGS. 3 and 9C). Subsequently, the tray 2, in which the transparent movable cover 2*b* is in the closed condition, is inserted through the insertion opening 4*a* into the interior of the unit body 3. Upon the complete insertion of the tray 2 into the unit body 3, the switch unit 9 operates to come into the ON state, whereupon the flashing bulb 6 flashes owing to the supply of the power from the dry battery 8 being a power source.

Figure 9C:
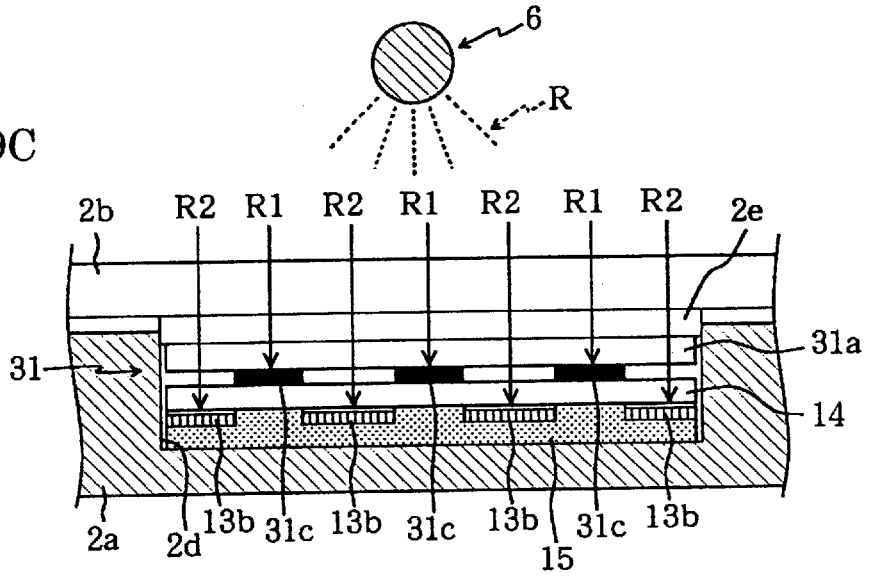
FIG. 9C is a cross-sectional view showing the bases at the application of light.
Figure 9D:
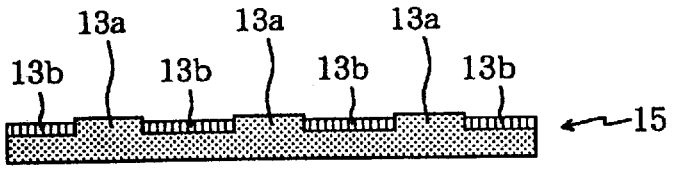
FIG. 9D is a cross-sectional view showing a stamp after plate-making.

As shown in FIG. 9C, when the flashing bulb 6 flashes, the infrared rays R of the light components pass through the transparent movable cover 2*b*, the transparent sheet 31*a* of the ultraviolet curing film 31 and the transparent PET sheet 14 to reach the upper surface of the ultraviolet curing layer 31*b*. At this time, the infrared ray R1 arriving at the light non-transmission section 31*c* of the ultraviolet curing layer 31*b* is intercepted by the light non-transmission section 31*c*, whereas the infrared ray R2 reaching the portion of the ultraviolet curing layer 31*b*, other than the light non-transmission section 31*c*, passes through the ultraviolet curing layer 31*b*. Accordingly, in the stamp base board 13, the infrared ray R1 does not come to the portion corresponding to the light non-transmission section 31*c* of the ultraviolet curing film 31, and hence, the carbon or the like in this portion does not conduct the heat generation. On the other hand, since the infrared ray R2 comes to the portion corresponding to other than the light non-transmission section 31*c* of the ultraviolet curing film 31, the heat generation of the carbon or the like takes place in this portion.

In consequence, in the surface of the stamp base board 13 which is brought into contact with the ultraviolet curing film 31, the heat generation of the carbon does not occur in the portion corresponding to the light non-transmission section 31*c* of the ultraviolet curing layer 31*b*, and therefore, the ink exuding section 13*a* is formed in a state of having the continuous voids as they are. On the other hand, in terms of the portion corresponding to other than the light non-transmission section 31*c*, the carbon or the like shows the heat generation, and hence, its surface is heated to be molten so that the continuous voids are closed to form the ink non-exuding section 13*b*, thereby manufacturing the stamp 15 shown in FIG. 9D.

Incidentally, in the case that the light non-transmission section 31*c* of the ultraviolet curing film 31 is colored with a black coloring matter, due to the infrared ray R1 applied from the transparent movable cover 2*b* side, the light non-transmission section 31*c* is heated to rise in temperature so that the heat generation takes place. However, since the transparent PET sheet 14 is interposed between the ultraviolet curing film 31 and the stamp base board 13 so that the light non-transmission section 31*c* is placed into contact with the transparent sheet 14, the heat accumulated in the light non-transmission section 31*c* is transferred to the transparent PET sheet 14, thereby resulting in heat radiation. Accordingly, in the stamp base board 13, the carbon or the like in the portion corresponding to the light non-transmission section 31*c* of the ultraviolet curing layer 31*b* does not show the heat generation, and therefore, the ink exuding section 13*a* can be formed in a state of having the continuous voids as they are.

Although the present invention has been described through the embodiments, it should be understood that it is intended to cover all changes and modifications of the embodiments of the invention herein used for the purpose of the disclosure, which do not constitute departures from the spirit and scope of the invention.

For instance, although in the first and third embodiments the negative film 12 and the photochromic film 11 or ultraviolet curing film 31 corresponding to the pattern sheet for plate-making are placed in a laminated condition, it is not always necessary that the negative film be brought into contact with the pattern sheet for plate-making. For example, it is also appropriate that a light transmission member is interposed between the negative film and the pattern sheet for plate-making. That is, it is acceptable as long as light from a light source can be applied through the negative film to the pattern sheet for plate-making.

Furthermore, although in the respective embodiments a foam resin such as a polyolefine-based resin is used for the stamp base board 13, it is also possible to use a rubber-based material. That is, it is acceptable as long as the stamp base board is made of a foam material and has a soft property when formed into a porous sheet.

Still further, although in the respective embodiments the carbon or the like is contained in the stamp base board 13 and the heat sheet 22 in a manner of the dispersion or the like, it is also appropriate that the material to be contained in the stamp base board and the heat sheet is a high molecular substance such as silver chloride and silver bromide, or an optical-energy absorbing substance. That is, all the substances are acceptable as long as they generate heat when heated by the application of light.

If using the method for manufacturing a pattern sheet for plate-making according to this invention, it is possible to manufacture a pattern sheet for plate-making, on which a positive image is formed through the use of a negative film with a negative image printed thereon, without separately dividing a portrait image section and a background image section like the prior pattern sheet for plate-making. Thus, it is possible to simplify the process for manufacturing a pattern sheet for plate-making and the stamp manufacturing process.

In addition, since there is no need to alternately bring the portrait image resin plate and the background image resin plate into contact with the foam resin plate for manufacturing the stamp, it is possible to avoid that the portrait image section and the background image section are overlapped with each other on the stamp printing surface. Accordingly, it is possible to easily produce a stamp with a vivid printing surface. When printed with this stamp, a clear printed image is obtainable.

Furthermore, since a pattern sheet for plate-making with a positive image is producible through the use of a photographic negative film, it becomes unnecessary to manufacture a pattern sheet for plate-making using a PPC copying machine. Accordingly, at the homes where the PPC copying machine has not sufficiently come into widespread use, it is possible to easily manufacture a desired pattern sheet for plate-making for a portrait or the like. Still further, since a pattern sheet for plate-making with a positive image is producible through the use of a photographic negative film, the image quality of the pattern sheet for plate-making becomes high and the print image by the plate-made stamp becomes clear.

The entire disclosure of the specification, summary, claims and drawings of Japanese Patent Application No. 9-78599 filed on Mar. 28, 1997 is herein incorporated by reference in its entirety.

What is claimed is:

1. A method for manufacturing a pattern sheet for plate-making, comprising:

a first step of placing a negative film with a printed negative image on a surface of a light transmission sheet carrying a photosensitive color-developing layer containing a photosensitive color-developing material which makes a color development in response to light, to form a laminate; and a second step of applying light to said laminate formed in said first step from the negative film side to make a color development in said photosensitive color-developing layer by said light passing through said negative image so that a positive image is formed on said surface of said light transmission sheet.

2. The method according to claim 1, wherein an ultraviolet ray is employed as said light, and a photochromic coating is used as said photosensitive color-developing material.

3. A method for manufacturing a pattern sheet for plate-making, comprising:

a first step of interposing a heat-generating sheet, including a heat-generating material whose temperature rises by applying light thereto, between a surface of a light transmission sheet carrying a thermosensitive color-developing layer containing a thermosensitive color-developing material making a color development in response to heat and a negative film with a negative image printed thereon to form a laminate; and a second step of applying light to said laminate formed in said first step from the negative film side to heat said heat-generating sheet by said light passing through said negative image so that color development takes place in said thermosensitive color-developing layer coming into contact with the heated portion of said heat-generating sheet, thus forming a positive image on said light transmission sheet surface.

4. The method according to claim 3, wherein the thermosensitive color-developing layer is formed, in the shape of a thin film having a substantially uniform thickness, on the upper surface of the light transmission sheet.

5. The method according to claim 4, wherein the thermosensitive color-developing layer is formed by impregnating or applying the thermosensitive color-developing material into or onto the upper surface of the light transmission sheet, respectively.

6. The method according to claim 3, wherein the thermosensitive color-developing material is made by finely dispersing a colorless coloring matter and a phenol compound in a binder.

7. The method according to claim 6, wherein the thermosensitive color-developing material, when heated, is molten in only the heated portion thereof so that the colorless coloring matter and the phenol compound are mixed, whereby the color development takes place.

8. The method according to claim 3, wherein the heat-generating sheet has a property that it generates heat when irradiated with an infrared ray.

9. The method according to claim 8, wherein the heat-generating sheet has a substantially uniform thickness.

10. The method according claim 3, wherein the heat-generating sheet is colored in black.

11. A method for manufacturing a pattern sheet for plate-making, comprising:

a first step of placing a negative film with a negative image printed thereon on a surface of a light transmission sheet carrying a photosensitive curing layer containing a photosensitive curing material curing in response to light and having a light non-transmission characteristic after cure, to form a laminate; and a second step of applying the light to said laminate formed in said first step from the negative film side to cure said photosensitive curing layer by said light passing through said negative image so that a positive image is formed on said light transmission sheet surface.

12. The method according to claim 11, wherein the photosensitive curing layer is formed, in the shape of a thin film having a substantially uniform thickness, on the upper surface of the light transmission sheet.

13. The method according to claim 12, wherein the photosensitive curing layer is formed by impregnating or applying the photosensitive curing material into or onto the upper surface of the light transmission sheet.

14. The method according to claim 12, wherein a light non-transmission coloring matter is impregnated into or applied onto the photosensitive curing material.

15. The method according to claim 11, wherein said second step includes a removal process for removing, of said photosensitive curing layer, said photosensitive curing material which is not cured by said light.

16. The method according to claim 11, wherein said light is an ultraviolet, and said photosensitive curing material is a colored ultraviolet curing resin.

* * * * *